US007430836B2

(12) United States Patent
Sibbett

(10) Patent No.: US 7,430,836 B2
(45) Date of Patent: Oct. 7, 2008

(54) DOOR WITH GLASS

(75) Inventor: Peter Sibbett, Tacoma, WA (US)

(73) Assignee: Capstone Engineering Co. Ltd., Changnyeong-Gun (KR)

( * ) Notice: Subject to any disclaimer, the term of this patent is extended or adjusted under 35 U.S.C. 154(b) by 321 days.

(21) Appl. No.: 11/110,183

(22) Filed: Apr. 19, 2005

(65) Prior Publication Data

US 2006/0080924 A1 Apr. 20, 2006

(30) Foreign Application Priority Data

Oct. 20, 2004 (KR) ..... 10-2004-0084101

(51) Int. Cl.
*E06B 1/04* (2006.01)
*E06B 3/70* (2006.01)
*E04C 2/38* (2006.01)

(52) U.S. Cl. ..... 52/208; 52/455; 52/656.7; 52/656.4; 52/204.54

(58) Field of Classification Search ..... 52/455, 52/456, 457, 458, 656.2, 656.3, 656.4, 656.5, 52/656.6, 656.7, 208, 784.1, 784.11, 784.12, 52/784.13, 784.14, 784.15, 784.16, 211, 52/204.53, 204.54, 212, 717.01, 785.1
See application file for complete search history.

(56) References Cited

U.S. PATENT DOCUMENTS 809,145 A * 1/1906 Sjobring ..... 52/784.13
1,180,726 A * 4/1916 Keil ..... 52/212
2,605,869 A * 8/1952 Backman ..... 52/770
3,492,770 A * 2/1970 Furner ..... 52/204.597
3,750,358 A * 8/1973 Lewkowitz ..... 52/204.597
4,550,542 A * 11/1985 La See ..... 52/476
5,189,862 A * 3/1993 Lafleur ..... 52/771
5,765,325 A * 6/1998 DeBlock ..... 52/204.5
5,987,844 A * 11/1999 Reid et al. ..... 52/656.5
6,151,849 A * 11/2000 Twigg et al. ..... 52/208
6,318,037 B1 * 11/2001 Hansen ..... 52/208
6,553,735 B1 * 4/2003 Wang Chen ..... 52/455
6,694,701 B2 * 2/2004 Wang et al. ..... 52/783.1
6,729,095 B2 * 5/2004 Wang Chen ..... 52/456
6,925,767 B2 * 8/2005 Krochmal et al. ..... 52/455
7,107,736 B2 * 9/2006 Barnard ..... 52/745.15
2003/0019178 A1 * 1/2003 Wang Chen ..... 52/455
2003/0037493 A1 * 2/2003 Guhl et al. ..... 52/208
2003/0056442 A1 * 3/2003 Gerard ..... 49/504
2003/0066256 A1 * 4/2003 DeBlock et al. ..... 52/208
2006/0005481 A1 * 1/2006 Ouellette ..... 52/204.1

* cited by examiner

*Primary Examiner*—Robert Canfield
*Assistant Examiner*—Ryan D Kwiecinski
(74) *Attorney, Agent, or Firm*—Lahive & Cockfield, LLP; EuiHoon Lee

(57) ABSTRACT

A door comprises a main frame with an opening, a front window frame and a rear window frame. The main frame includes a connection mold formed along an inner circumference of the opening and formed with a plurality of projections and recessed hooking channels. A glass is disposed in the opening and fixed by the front window frame and the rear window frame. The front window frame includes catching protrusions to be fitted into the recessed hooking channels, a support end to support the glass, and hooks protruding rearward and resiliently hooked to a rear side of the projections. The rear window frame includes catching protrusion to be fitted into the other recessed hooking channels, a support end to support the glass, and hooks protruding frontward and resiliently hooked to a front side of the projections.

8 Claims, 5 Drawing Sheets

DOOR WITH GLASS

RELATED APPLICATIONS

This application claims priority to Korean Patent Application No. 2004-0044160 filed on Oct. 20, 2004.

BACKGROUND OF THE INVENTION

1. Field of the Invention

The present invention relates to a door, and more particularly, to a door with glass installed to a central opening thereof.

2. Description of the Related Art

Generally, there are many problems when glass is installed at the center of a door made of wood. In particular, when the installed glass is large, there are many problems in that moisture should be prevented from penetrating from the outside, the whole frames should be firmly supported, the glass installed to the center of the door should be supported, and the manufacturing process is also complicated.

In the conventional door to which glass is installed, the same problems as mentioned above are produced when a metal or synthetic resin frame as well as a wood frame is used in the door.

SUMMARY OF THE INVENTION

The present invention is conceived to solve the aforementioned problems in the prior art. Accordingly, an object of the present invention is to provide a door that is capable of ensuring whole strength of frames as well as firmly supporting glass installed at the center thereof.

Another object of the present invention is to provide a door capable of efficiently preventing moisture penetration from the outside.

A further object of the present invention is to provide a door having a sufficient heat insulation property.

A still further object of the present invention is to provide a door of which productivity can be improved by simplifying its assembling process.

A still further object of the present invention is to provide a door with improved stability that can be firmly supported so that a glass window cannot be broken due to strong wind.

According to an aspect of the present invention for achieving the objects, there is provided a door, comprising: a main frame with an opening formed at the center thereof for mounting glass to the opening, said main frame including a connection mold formed along an inner circumference of the opening, said connection mold being formed with a plurality of projections and recessed hooking channels disposed in opposite directions; a front window frame including catching protrusions extending rearward from an outer end thereof to be fitted into the one recessed hooking channel, a support end formed on an inner end thereof to support the glass by coming into close contact with a front surface of the glass, and hooks resiliently hooked to a rear side of the projections; and a rear window frame including catching protrusion extending forward from an outer end thereof to be fitted into the other recessed hooking channel, a support end formed on an inner end thereof to support the glass by coming into close contact with a rear surface of the glass, and hooks resiliently hooked to a front side of the projections.

According to other aspect of the present invention for achieving the objects, there is provided a door, comprising: a main frame with an opening formed at the center thereof for mounting glass to the opening, said main frame including a connection mold formed along an inner circumference of the opening, said connection mold being formed with a plurality of projections; a front window frame including an outer end caught into a front end of the main frame adjacent to the opening, a support end formed on an inner end thereof to support the glass by coming into close contact with a front surface of the glass, and hooks resiliently hooked to a rear side of the projections; and a rear window frame including an outer end caught into a rear end of the main frame adjacent to the opening, a support end formed on an inner end thereof to support the glass by coming into close contact with a rear surface of the glass, and hooks resiliently hooked to a front side of the projections.

Preferably, screw bosses are formed at predetermined corresponding positions of the front and rear window frames to fasten the front and rear window frames by means of screws.

More preferably, the hooks formed on the front and rear window frames to be hooked to the projections are formed at positions where the hooks do not interfere with each other.

More preferably, a foaming agent is filled in the main frame.

According to the present invention so configured, since a window frame is more firmly fastened to a main frame to securely support glass, there are advantages in that the door can have improved reliability and sufficiently prevent external moisture from penetrating into a house through the door.

BRIEF DESCRIPTION OF THE DRAWINGS

The above and other objects, features and advantages of the present invention will become apparent from the following description of a preferred embodiment given in conjunction with the accompanying drawings, in which.

DESCRIPTION OF THE PREFERRED EMBODIMENT

Hereinafter, the present invention will be described in more detail with reference to a preferred embodiment illustrated in the accompanying drawings.

Figure 1A:
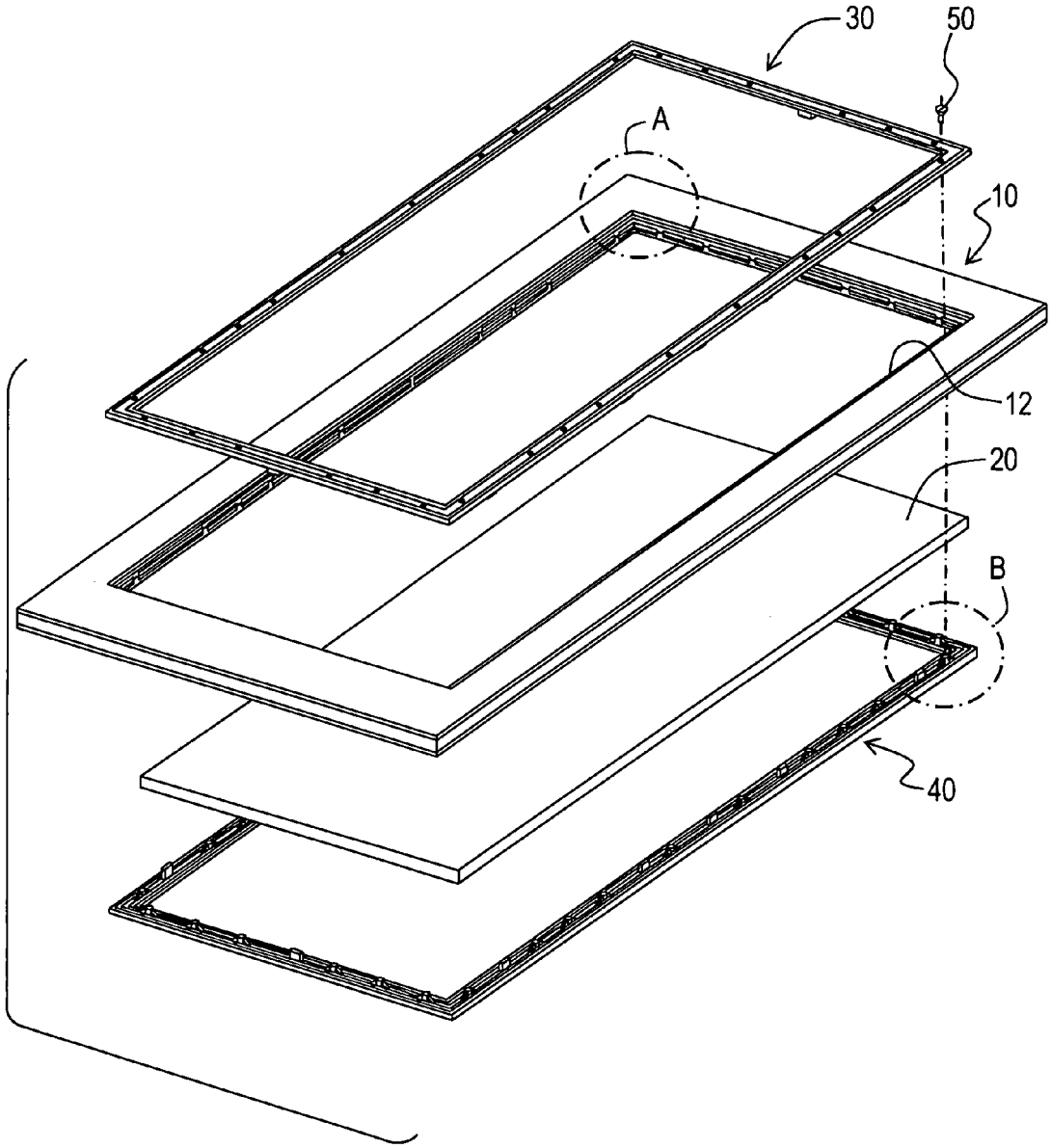
FIG. 1*a* is an exploded perspective view of a door according to the present invention.
Figure 1B:
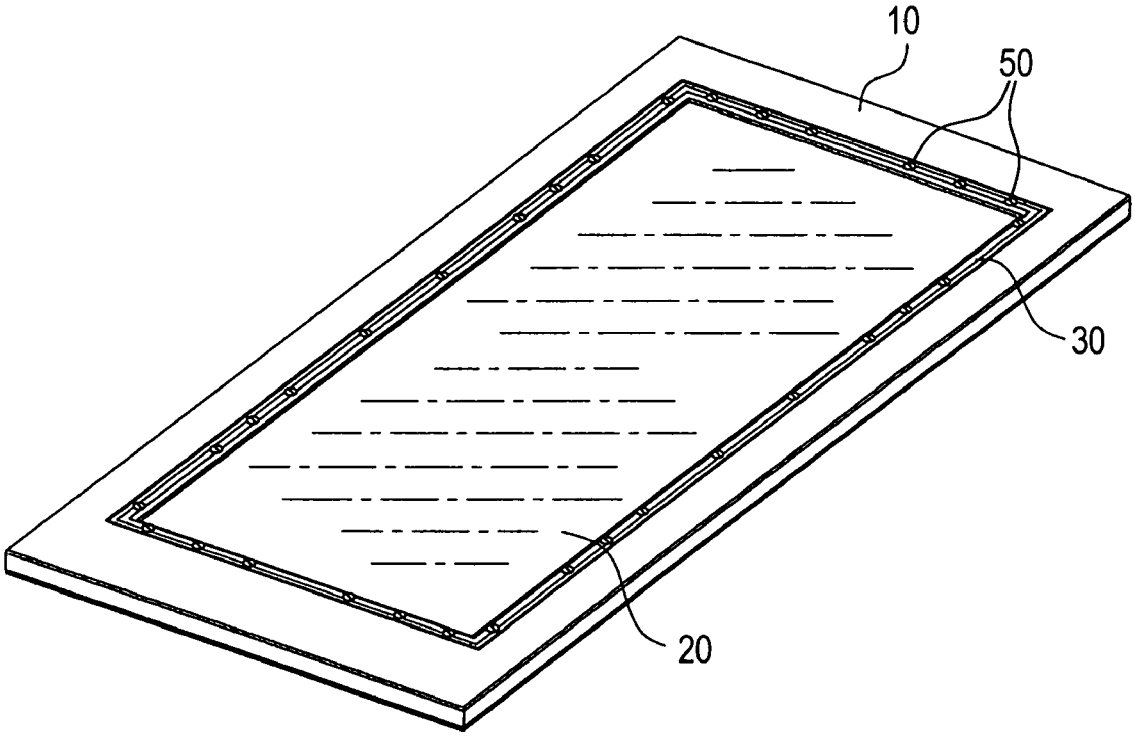
FIG. 1*b* is an assembled perspective view of the door according to the present invention.

FIGS. 1*a* and 1*b* show a door of the present invention. As shown in FIGS. 1*a* and 1*b*, the door of the present invention includes a main frame 10 with an opening 12 formed at the center thereof, glass 20 mounted to the opening 12 of the main frame 10, and front and rear window frames 30 and 40 assembled to edges of the opening 12 of the main frame 10 to support the glass 20 at both sides thereof.

The opening 12 is formed at the center of the main frame 10 so that the glass 20 can be mounted thereto. As seen from FIGS. 2 to 4, a connection mold 13 is formed to circumscribe an inner circumference of the opening 12. The connection mold 13 is formed with a plurality of projections 14. The plurality of projections 14 are formed on a surface of the connection mold 13 such that the front and rear window frames 30 and 40 to be explained later can be fastened thereto. As seen from FIG. 2, hooking channels 16 are formed at portions where the connection mold 13 is connected to the main frame 10. The hooking channels 16 are recessed at front and rear sides of the main frame 10.

In addition, the main frame 10 of the present invention is preferably made of synthetic resin, and also possibly made of wood and other materials. For example, the main frame may be configured in such a manner that the front and rear sides of the main frame corresponding to lateral sides of the main frame itself are made of a glass fiber or thin synthetic resin plate (or film) and a foaming agent 11 is then filled therebetween. Further, the main frame may be configured in such a manner that it is integrally made of other synthetic resin material and a foaming agent is then filled into the synthetic resin material.

When the main frame 10 is made of synthetic resin and a foaming agent 11 is filled therein, it is preferred that the main frame 10 be made of reinforced plastic to ensure sufficient strength. In another embodiment, a foaming agent may not be filled in the main frame 10. Further, the figures show that front and rear portions of the main frame 10 are individually manufactured and then assembled.

In addition, a pair of window frames 30 and 40 are fastened to front and rear portions on the inner circumference of the opening 12 of the main frame 10. The window frames 30 and 40 are also formed of synthetic resin and firmly fastened to the main frame 10 so as to allow the glass 20 to be supported therebetween. As seen from FIGS. 2 and 3, catching protrusions 32 and 42 are respectively formed at outer edges of the window frames 30 and 40 to be fitted into the recessed hooking channel 16.

Since the catching protrusions 32 and 42 are coupled with the hooking channel 16, external moisture cannot be substantially penetrated into a house. That is, since the catching protrusions 32 and 42 are fitted into the recessed hooking channel 16, any gap can be prevented therebetween to the utmost, whereby the penetration of moisture into a house can be efficiently prevented. Further, since the catching protrusions 32 and 42 and the hooking channel 16 are coupled with one another, heat insulation between the inside and outside of a house can be substantially ensured more perfectly.

Figure 4:
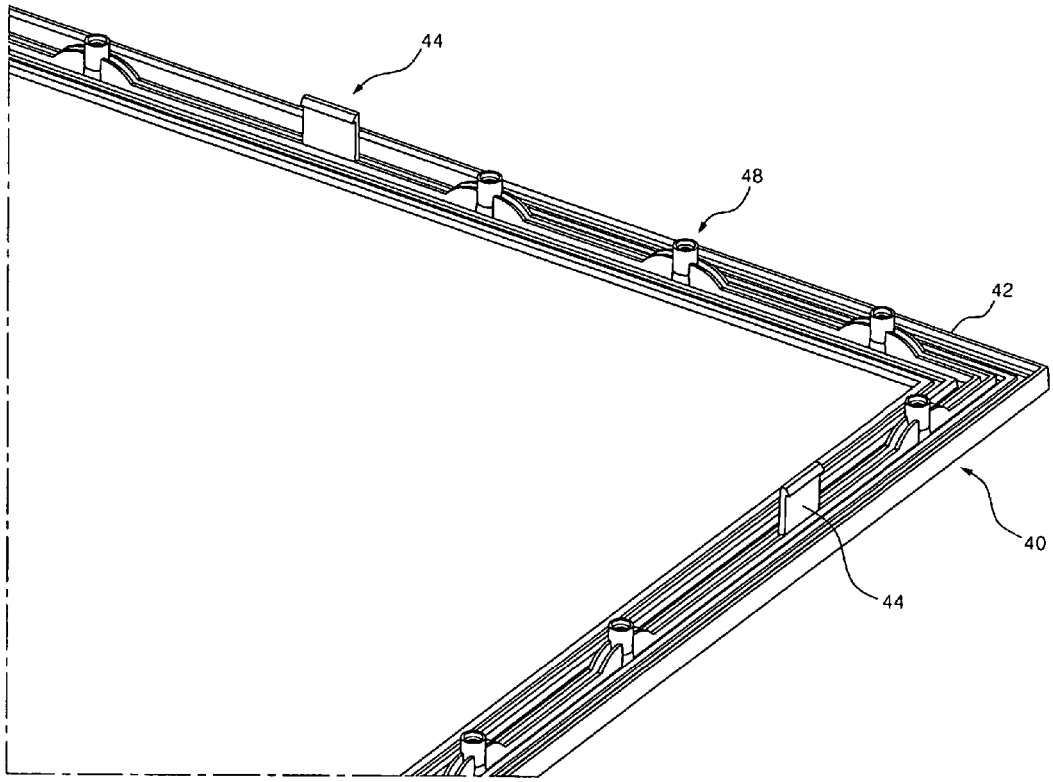
FIG. 4 is an enlarged view showing a B portion in FIG. 1.

In addition, although only the rear window frame 40 among the pair of the window frames 30 and 40 is illustrated in FIG. 4, the window frames 30 and 40 substantially have the same shape as each other, i.e. are formed to be symmetrical with each other. As seen from FIGS. 2 and 4, a plurality of hooks 34 and 44 are formed on the widow frames 30 and 40 to protrude from the frames in the opposite directions, respectively. The front window frame 30 is provided with elastic hooks 34 protruding rearward, and the rear window frame 40 is provided with elastic hooks 44 protruding forward. The hooks 34 and 44 allow the window frames 30 and 40 to be fastened to the main frame 10 in cooperation with the catching protrusions 32 and 42. That is, the hooks 34 and 44 and the projections 32 and 42 provide a coupling force with the connection mold 13 in the opposite directions such that the window frames 30 and 40 can be firmly fastened to the main frame 10.

Furthermore, the hooks 34 and 44 are hooked to upper and lower ends of the projections 14, respectively, so that each of the window frames 30 or 40 can be supported on and fastened to the main frame 10. That is, referring to FIG. 2, the hook 34 of the front window frame 30 is resiliently hooked to the bottom of the projection 14 (i.e., the back of a door when the door is actually installed). Further, the hook 44 of the rear window frame 40 is resiliently hooked to the top of the projection 14 (i.e., the front of a door when the door is actually installed). At this time, if the hook 34 of the front window frame 30 and the hook 44 of the rear window frame 40 are formed at the substantially same positions, they can interfere with each other. Therefore, the hook 34 of the front window frame 30 and the hook 44 of the rear window frame 40 should be formed at a plurality of positions spaced apart from one another such that the hooks cannot interfere with each other.

In addition, support ends 36 and 46 are formed on the inner ends of the window frames 30 and 40 such that the support ends can be brought into contact with the both sides of the glass 20, respectively, to support the glass 20. The support ends 36 and 46 are formed to sufficiently clamp the glass 20 at both sides of the glass 20 in a state where the glass is interposed between the support ends. Thus, it is apparent that the shape of and interval between the support ends 36 and 46 can be properly adjusted according to the size of the glass to be installed.

As clearly seen in FIG. 4, a plurality of screw bosses 48 protruding forward are formed on the rear window frame 40. Similarly, a plurality of screw bosses protruding rearward are also formed on the front window frame 30 at the same positions. Further, when the front window frame 30 and the rear window frame 40 are coupled with each other, the plurality of screw bosses 48 abut each other, and the screw bosses are then coupled by using screws 50 (FIGS. 1*a* and 1*b*) in such a state.

As mentioned above, since the front and rear window frames 30 and 40 are fastened to each other using the screw bosses 48 formed to face each other at the sane positions, the front and rear window frames 30 and 40 becomes in a state where they can be more firmly fastened to each other.

According to the present invention so configured, the glass 20 is supported between the support ends 36 and 46 that are formed on the window frames 30 and 40, respectively. Further, the window frames 30 and 40 are firmly fastened to the main frame 10 by means of the plurality of elastic hooks 34 and 44 and the screws, as described above. Thus, the glass 20 can be firmly supported by the pair of the window frames 30 and 40 fastened to the main frame 10. Such a glass supporting structure has an advantage in that it can sufficiently support the glass against an external force such as strong wind or external impact.

The process of assembling the door according to the present invention so configured will be hereinafter discussed. As shown in FIG. 1*a*, the door is assembled by sequentially combining the rear window frame 40, the glass 20, the main frame 10 and the front window frame 30 from bottom to top.

Figure 2:
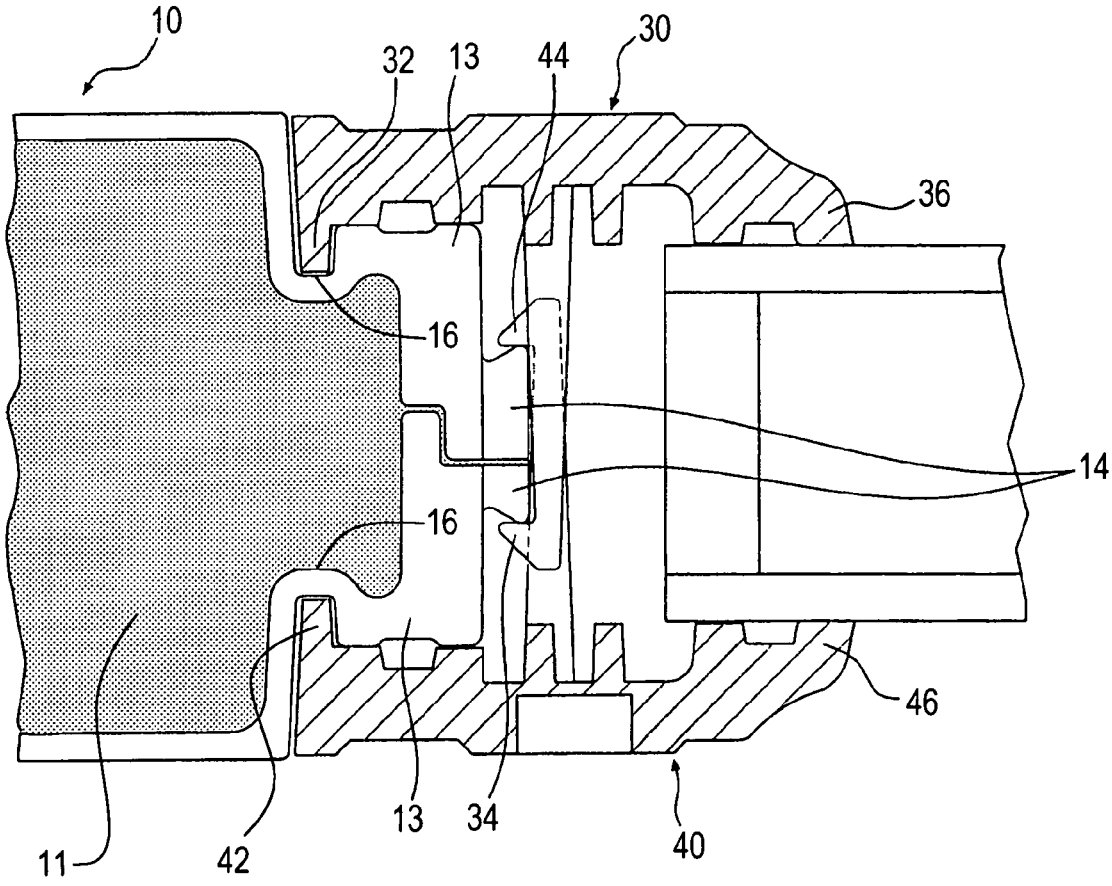
FIG. 2 is a sectional view showing essential parts of the door according to the present invention.
Figure 3:
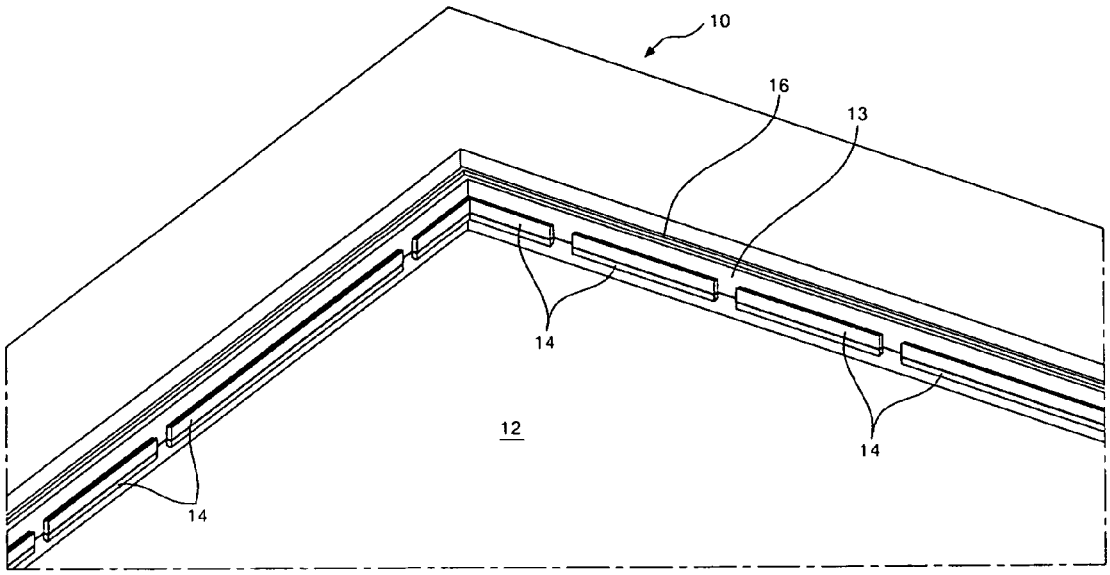
FIG. 3 is an enlarged view showing an A portion in FIG. 1.

After the door of the present invention is completely assembled in this way, the catching protrusions 32 and 42 formed respectively on the outer side of the window frames 30 and 40 are coupled into both of the recessed hooking channels 16 of the main frame 10, respectively, as shown in FIG. 2. Further, the hooks 34 and 44 at the front and rear window frames are resiliently hooked to the front and rear sides of the projections 14, respectively, and the front and rear window frames 30 and 40 are then fastened to each other by using the screws as mentioned above.

If the window frames 30 and 40 are fastened to each other in this way, the support ends 36 and 46 formed on the inner side of the window frames 30 and 40 can be substantially used to support the glass 20 in such a state where the glass 20 is interposed between the support ends.

In addition, if the window frames 30 and 40 are fastened as mentioned above, the window frames 30 and 40 are firmly supported between the main frame 10 and the glass 20. Thus, it will be understood that the door can be assembled by completely bringing the glass into close contact with the window frames using the aforementioned hooks 34 and 44 and that the glass is not inadvertently detached from the frames due to an external force.

Furthermore, the door of the present invention can be produced by means of the simple assembling process as mentioned above. From the face that the process of assembling the door according to the present invention is simple, the advantages in that the production cost reduction and productivity improvements are substantially obtained can be of course expected.

It will be apparent that those skilled in the art can make various modifications and changes within the scope of the fundamental technical spirit of the present invention. Accordingly, the scope of the present invention should be construed on the basis of the appended claims.

For example, although it has been described in the illustrated embodiment that the catching protrusions 32 and 42 of the window frames 30 and 40 are hooked into the recessed hooking channels 16 of the connection mold 13, the present invention is not necessarily limited thereto. Alternatively, the outer ends of the window frames may be caught into the front end of the main frame adjacent to the opening.

According to the present invention as described above, the following advantages can be expected.

First, it can be understood that the window frames and the main frame are firmly fastened and supported by means of the hooks. Thus, structural strength between the window frame and the main frame and between the window frame and the glass is increased, and consequently, a reliable door can be generally obtained.

Further, since the window frames and the main frame are coupled with one another, there is an advantage in that inadvertent detachment of the glass due to an external force can be securely prevented.

Furthermore, since the catching protrusions of the window frames are coupled into the hooking channels of the main frames, the penetration of external moisture into a house can be sufficiently prevented.

What is claimed is:

1. A door, comprising:

a main frame with an opening formed at the center thereof for mounting glass to the opening, said main frame including a connection mold formed along an inner circumference of the opening, said connection mold being formed with a plurality of projections and recessed hooking channels disposed in opposite directions;

a front window frame including catching protrusions extending rearward from an outer end thereof to be fitted into one of the recessed hooking channels, a support end formed on an inner end thereof to support the glass by coming into close contact with a front surface of the glass, and hooks protruding rearward and resiliently hooked to a rear side of the projections; and a rear window frame including catching protrusions extending forward from an outer end hereof to be fitted into the other recessed hooking channel of the recessed hooking channels, a support end formed on an inner end thereof to support the glass by coming into close contact with a rear surface of the glass, and hooks protruding frontward and resiliently hooked to a front side of the projections, wherein the projections are extending along an inner circumference of the main frame, and the hooks of the front and rear window frames are bent toward the main frame and hooked to the same projections in the opposite direction.

2. The door as claimed in claim 1, wherein screw bosses are formed at predetermined corresponding positions of the front and rear window frames to fasten the front and rear window frames by means of screws.

3. The door as claimed in claim 1, wherein the hooks formed on the front and rear window frames to be hooked to the projections are formed at positions where the hooks do not interfere with each other.

4. The door as claimed in claim 1 wherein a foaming agent is filled in the main frame.

5. A door, comprising:

a main frame with an opening formed at the center thereof for mounting glass to the opening, said main frame including a connection mold formed along an inner circumference of the opening, said connection mold being formed with a plurality of projections;

a front window frame including an outer end fixed to a front end of the main frame adjacent to the opening, a support end formed on an inner end thereof to support the glass by coming into close contact with a front surface of the glass, and hooks protruding rearward and resiliently hooked to a rear side of the projections; and a rear window frame including an outer end fixed to a rear end of the main frame adjacent to the opening, a support end formed on an inner end thereof to support the glass by coming into close contact with a rear surface of the glass, and hooks protruding frontward and resiliently hooked to a front side of the projections, wherein the projections are extending along an inner circumference of the main frame, and the hooks of the front and rear window frames are bent toward the main frame and hooked to the same projections in the opposite direction.

6. The door as claimed in claim 5, wherein screw bosses are formed at predetermined corresponding positions of the front and rear window frames to fasten the front and rear window frames by means of screws.

7. The door as claimed in claim 5, wherein the hooks formed on the front and window rear window frames to be hooked to the projections are formed at positions where the hooks do not interfere with each other.

8. The door as claimed in claim 5, wherein a foaming agent is filled in the main frame.

* * * * *